US009086217B2

(12) United States Patent
Eckert et al.

(10) Patent No.: US 9,086,217 B2
(45) Date of Patent: Jul. 21, 2015

(54) LIGHTING APPARATUS

(75) Inventors: Klaus Eckert, Herbrechtingen (DE); Markus Hofmann, Bad Abbach (DE)

(73) Assignee: Osram GmbH, Munich (DE)

( * ) Notice: Subject to any disclaimer, the term of this patent is extended or adjusted under 35 U.S.C. 154(b) by 12 days.

(21) Appl. No.: 14/003,483

(22) PCT Filed: Feb. 24, 2012

(86) PCT No.: PCT/EP2012/053176

§ 371 (c)(1),
(2), (4) Date: Sep. 6, 2013

(87) PCT Pub. No.: WO2012/123233

PCT Pub. Date: Sep. 20, 2012

(65) Prior Publication Data

US 2013/0343055 A1 Dec. 26, 2013

(30) Foreign Application Priority Data

Mar. 16, 2011 (CN) ..... 10 2011 005 597

(51) Int. Cl.

| | |
|---|---|
| ***F21V 15/01*** | (2006.01) |
| ***F21V 31/03*** | (2006.01) |
| ***F21V 23/00*** | (2015.01) |
| ***F21V 29/00*** | (2015.01) |
| ***F21K 99/00*** | (2010.01) |
| ***F21V 29/70*** | (2015.01) |
| *F21Y 101/02* | (2006.01) |
| *F21V 3/00* | (2015.01) |
| *F21V 29/74* | (2015.01) |

(52) U.S. Cl.

CPC ..... *F21V 31/03* (2013.01); *F21K 9/1355* (2013.01); *F21V 23/003* (2013.01); *F21V 29/004* (2013.01); *F21V 29/70* (2015.01); *F21V 3/00* (2013.01); *F21V 23/002* (2013.01); *F21V 29/74* (2015.01); *F21Y 2101/02* (2013.01)

(58) Field of Classification Search

CPC ..... F21V 31/03; F21V 29/22

See application file for complete search history.

(56) References Cited

U.S. PATENT DOCUMENTS

| | | | | |
|---|---|---|---|---|
| 6,874,924 | B1 * | 4/2005 | Hulse et al. | 362/551 |
| 8,864,345 | B2 * | 10/2014 | Bakk | 362/311.02 |
| 2007/0121336 | A1 | 5/2007 | Chinniah et al. | |
| 2008/0113523 | A1 | 5/2008 | Owen et al. | |
| 2009/0175041 | A1 | 7/2009 | Yuen et al. | |
| 2009/0268475 | A1 | 10/2009 | Ball et al. | |
| 2011/0304268 | A1 | 12/2011 | Bertram et al. | |

(Continued)

FOREIGN PATENT DOCUMENTS

| | | | |
|---|---|---|---|
| DE | 29519429 | U1 | 2/1996 |
| DE | 29710696 | U1 | 8/1997 |

(Continued)

OTHER PUBLICATIONS

English abstract of DE 102005045730A1, dated Apr. 26, 2007.

*Primary Examiner* — Anabel Ton

(57) ABSTRACT

A lighting device includes at least one space for receiving at least one functional element, the space being connected to at least one semipermeable transmission element and otherwise closed off in a sealed manner and the at least one transmission element being transmissive to air in both directions and non-transmissive to water, at least in the direction of the space.

18 Claims, 9 Drawing Sheets

(56) References Cited

U.S. PATENT DOCUMENTS

2012/0287637 A1* 11/2012 Mahalingam et al. ... 362/249.02
2014/0268769 A1* 9/2014 Tran ..... 362/249.02

FOREIGN PATENT DOCUMENTS

DE 102005045730 A1 4/2007
DE 102009010180 A1 10/2010

* cited by examiner

LIGHTING APPARATUS

RELATED APPLICATIONS

The present application is a national stage entry according to 35 U.S.C. §371 of PCT application No.: PCT/EP2012/053176 filed on Feb. 24, 2012, which claims priority from German application No.: 10 2011 005 597.5 filed on Mar. 16, 2011.

TECHNICAL FIELD

Various embodiments relate to a lighting device, in particular a retrofit lamp, which has at least one space for receiving at least one functional element, for example a light source or a driver.

BACKGROUND

LED retrofit lamps, which have light-emitting diodes (LEDs) as light sources and are intended to replace conventional lamps, are used mainly indoors in buildings, since the electronic components and LEDs thereof react sensitively to moisture and pollutants. There are known LED retrofit lamps for use outdoors, which are completely sealed in order to prevent any ingress of moisture. In the case of such lamps, a bulb space in which the LEDs are accommodated is sealed by a light-transmissive bulb being either adhesively bonded or ultrasonically welded to a plastic housing. However, the heating up and cooling down of the LED retrofit lamp during operation causes a positive or negative pressure to form in the bulb space, which may damage joints of the bulb space (the adhesive bonding or welding). As a consequence, moisture may get into the bulb space, in particular be drawn into the lamp by the negative pressure. Moisture that has been drawn into the bulb space may then no longer escape, however, because the bulb space is sealed too much for this. As a consequence, corrosion may occur and/or increased degradation of components (electrical lines, electronic components, light-emitting diodes, etc.) in the bulb space.

SUMMARY

Various embodiments provide a lighting device, in particular a semiconductor lighting device, with improved suitability for outdoors.

Various embodiments provide a lighting device, having at least one space for receiving at least one functional element, the space being connected to at least one semipermeable transmission element and otherwise closed off in a sealed manner and the at least one transmission element being transmissive to air in both directions and non-transmissive to water, at least in the direction of the space.

Thus, when there is alternating thermal loading of the space, a pressure equalization is made possible by the air permeability of the transmission element, whereby mechanical loading of joints and other structurally weak regions of the housing bounding the space is reduced. The transmission element therefore serves as a pressure equalizing element. Consequently, an impermeability of the space and a strength of the housing are retained even during operation over a long time. The fact that the transmission element is non-transmissive to water, at least in the direction of the space, means that there also cannot be any ingress of moisture, which protects the functional elements accommodated in the space. Altogether, such a lighting device can be easily used outdoors, where levels of ambient moisture are typically higher than indoors.

The semipermeable transmission element may in particular have at least one semipermeable membrane.

The space may be connected to an area outside the lighting device by way of the at least one semipermeable transmission element. In other words, the transmission element may on the one hand be connected (directly or indirectly) to the space, and on the other hand be connected (directly or indirectly) to an area outside the lighting device (i.e. to the outside).

It is a configuration in which at least one transmission element is only non-transmissive to water in the direction of the space, and consequently is transmissive to water out from the space. Thus, moisture that remains in the space (for example was present during the production of the lighting device or gets in through leakage gaps) may be at least partially removed by the operation of the lighting device, which further increases longevity.

There is an alternative or additional configuration in which at least one transmission element is non-transmissive to water in both directions. Such a transmission element may be less expensive than a unidirectionally acting transmission element. In particular, if the space only contains little moisture during the production of the lamp, good protection against corrosion etc. is made possible by preventing any ingress of additional water (in particular in the form of moisture).

There is also a configuration in which the space is what is known as a bulb space, which is partially bounded by a light-transmissive covering (often also known as a 'bulb'), and the at least one functional element has or is at least one light source, in particular a semiconductor light source. It is in this way possible to prevent damage to the joints of the covering and degradation of and/or damage to the light source(s) and other electrical or electronic components in the bulb space. This makes it possible for a high degree of optical effectiveness to be maintained over a long time.

There is a special configuration in which the space is partially bounded by a heat sink, which is connected in a sealed manner to the covering and on which the at least one light source is arranged. The heat sink may, for example, consist of aluminum or of plastic with good thermal conduction. The covering may in particular consist of plastic or glass.

There is a special configuration in which the at least one light source is mounted on a substrate,

- the substrate is fastened on a front side of the heat sink,
- a through-opening, which opens out at the front side and is closed by means of the transmission element, runs through the heat sink,
- a longitudinal groove, which adjoins the through-opening, runs in the front side,
- the through-opening and at least part of the longitudinal groove that extends from the through opening are covered, so that they form a common fluid channel, and
- the end of the longitudinal groove opposite from the through-opening is fluidically connected to the bulb space.

This makes possible a fluidic connection between the bulb space and the outside that is semipermeably transmissive through the transmission element, a sufficiently long air and creepage path being provided by the common fluid channel in a simple way. The through-opening and the at least part of the longitudinal groove may be covered by the substrate and/or by a heat conducting element that is present at least between the substrate and the front side (sturdy heat conducting sheet, heat conducting pad, heat conducting plate or the like). The longitudinal groove may be partially or completely covered over. The longitudinal groove may be easily formed in the heat sink and covered.

The through-opening may, for example, run through a front region of the heat sink. The longitudinal groove may in particular be formed in the front region of the heat sink.

There is yet a further configuration in which the longitudinal groove is made to extend up to an upright periphery of the front side and in which the longitudinal groove adjoins a clearance of the periphery that is adjacent the bulb space. Fluidic access to the bulb space of the fluid channel formed by the covered groove is thus ensured still further, to be specific for all degrees of coverage of the substrate (or a heat conducting material lying thereunder). Consequently, the fluidic access to the bulb space is still ensured even if the substrate completely covers over the groove up as far as the periphery.

The substrate may be, for example, a printed circuit board or a ceramic substrate of a submount.

It is a development that the substrate is fastened flat on the heat sink by way of a heat conducting material (in particular TIM; "Thermal Interface Material"). The heat conducting material may be, for example, a heat conducting sheet, a heat conducting pad, etc. The groove is then at least partially covered over directly by the heat conducting material, without the groove being filled by it.

It is a development that the heat sink has a front region, which may serve inter alia as a bearing region for the fastening of the at least one semiconductor light source. The front region may in particular be in the form of a plate or panel, in particular in the form of a circular disk. The through-opening may then be formed as a simple bore, in particular a passing-through bore.

From the front region of the heat sink there may extend in particular cooling ribs or cooling struts, in particular in a rearward direction, in particular from a peripheral region of the front region.

Alternatively or additionally, the transmission element may be attached to the bulb.

There is another configuration in which the space is a driver cavity and the functional element is a driver for feeding at least one light source. The driver may generate not inconsiderable waste heat during the operation of the lighting device. This configuration allows the driver to be protected from increased corrosion caused by moisture getting in, and moreover a driver housing forming the driver cavity may be better protected against tearing open of joints. The driver has in particular electronic components ("driver electronics") and/or a transformer, etc.

There is a special configuration in which the bulb space and the driver cavity are fluidically connected to one another. This (outwardly sealed) connection may be, for example, a cable duct for leading through at least one electrical line from the driver to the at least one light source. For pressure equalization and moisture removal from both spaces, at least one transmission element may be connected to the bulb space, to the driver cavity or to both. Thus, the pressure equalization of the driver cavity may, for example, also be carried out by a transmission element at the bulb space.

There is also a configuration in which the driver cavity is bounded by a driver housing and the driver housing has a through-opening which opens out into the driver cavity and leads through a reinforced region of the driver housing. This makes desired dimensioning of the through-opening possible with respect to its length and/or width (by providing the surrounding material through the reinforced region), for example to provide a sufficient air and creepage path by a suitable length of the through-opening. For simple production, the through-opening is preferably a bore.

There is also a configuration in which the driver cavity is bounded by a driver housing and the driver housing has a through-opening leading through the driver housing or a wall thereof, there being in the driver cavity a separating wall of a laterally limited extent, which covers over the through-opening at a distance from it. It is in this case possible to dispense with a reinforced region, and the through-opening may, for example, be led through a wall of normal wall thickness. The separating wall makes it possible to maintain sufficient air and creepage paths. The through-opening may in particular run transversely in relation to the housing or the wall thereof.

There is also a configuration in which a semipermeable plug is inserted in the through-opening. This plug may in particular be inserted easily and firmly. The plug may in particular have a (fluid) channel that is covered over by a semipermeable membrane.

There is an alternative or additional configuration in which the through-opening is covered over adhesively by the transmission element. Thus, short through-openings and/or through-openings with a small installation space around them may also be of a semipermeable design.

There is also a configuration in which the transmission element has at least one membrane. It is advantageous for easy assembly if the transmission element may be adhesively attached, in particular is self-adhesive.

As an alternative to adhesive attachment, the transmission element may in general be screwed, pressed into place or molded into place. For molding into place in particular, the transmission element has at least one membrane that is surrounded by a plastic body.

The transmission element may then be molded into place in particular in a plastic housing.

There is yet a further configuration in which the lighting device is a retrofit lamp, in particular an incandescent retrofit lamp or a halogen retrofit lamp.

It is a development that the lighting device has at least one semiconductor light source and is therefore a semiconductor lighting device. More preferably, the at least one semiconductor light source comprises at least one light-emitting diode. If there are a number of light-emitting diodes, they may light up in the same color or in different colors. A color may be monochrome (for example red, green, blue, etc.) or multichrome (for example white). The light emitted by the at least one light-emitting diode may also be an infrared light (IR-LED) or an ultraviolet light (UV-LED). A number of light-emitting diodes may generate a mixed light; for example a white mixed light. The at least one light-emitting diode may contain at least one wavelength-converting phosphor (conversion LED). The phosphor may alternatively or additionally be arranged remote from the light-emitting diode ("remote phosphor"). The at least one light-emitting diode may take the form of at least one single packaged light-emitting diode or the form of at least one LED chip. A number of LED chips may be mounted on a common substrate ("submount"). The at least one light-emitting diode may be equipped with at least one optical system of its own and/or a shared optical system for beam guidance, for example at least one Fresnel lens, collimator, and so on. Instead of or in addition to inorganic light-emitting diodes, for example based on InGaN or AlInGaP, organic LEDs (OLEDs, for example polymer OLEDs) may generally also be used. Alternatively, the at least one semiconductor light source may, for example, have at least one diode laser.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
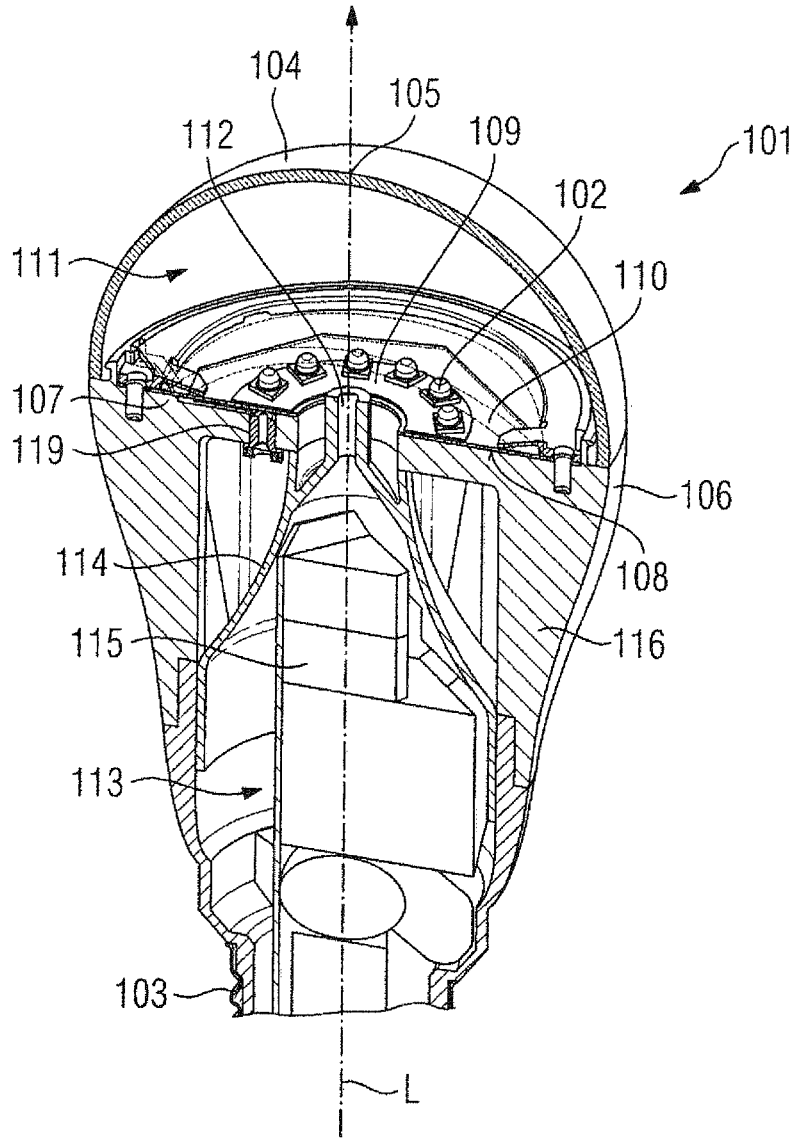
FIG. 1 shows as a sectional representation in an oblique view a cutout from a lighting device according to a first embodiment, configured as an incandescent retrofit lamp.

FIG. 1 shows as a sectional representation in an oblique view a cutout from a lighting device 101 according to a first embodiment, configured as an LED incandescent retrofit lamp. The lighting device 101 uses light-emitting diodes 102 as (semiconductor) light sources and is intended for replacing a conventional incandescent lamp. The lighting device 101 has for this purpose an electrical connection 103 that is the same, or has the same effect, as the incandescent lamp to be replaced and has an at least roughly approximate outer contour, which particularly does not exceed an outer contour of the conventional incandescent lamp, or not by much. The electrical connection 103 is configured here as an Edison base and represents a rear or rearward end of the lighting device 101.

A front end of the lighting device 101 is formed by a spherical dome-shaped, light-transmissive covering 104, in particular by the apex or tip 105 thereof. The covering 104 arches over the light-emitting diodes 102 and rests in a sealed manner on an outer periphery of a heat sink 106, for example by means of a combination of adhesive bonding and interlocking.

The heat sink 106 has a circular disk-shaped front region 107, from the peripheral region of which cooling struts 116 extend in a rearward direction (counter to a longitudinal axis L). Fastened with its rear side flat against a planar front side 108 of the front region 107 of the heat sink 106 that is directed forward, i.e. in the direction of the longitudinal axis L, is an annular substrate 109, by way of a heat conducting sheet 110. The front side of the substrate 109 is loaded with the light-emitting diodes 102.

The covering 104 and the front region 107 of the heat sink 106 form a space that is in principle closed off in a sealed manner, the 'bulb space' 111, for receiving at least the light-emitting diodes 102 as functional elements.

The bulb space 111 is connected fluidically (air- and moisture-transmissively) to a driver cavity 113 by way of a cable duct 112. The cable duct 112 is tubular and protrudes perpendicularly through the front region 107 and the heat conducting sheet 110 through a central clearance of the substrate 109 into the bulb space 111. Electrical connecting lines (not illustrated) can be led through the cable duct 112 from the driver cavity 113 to the substrate 109 or to the light-emitting diodes 102.

The driver cavity 113 is located in a driver housing 114 and receives a driver 115 as a functional element for feeding the light-emitting diodes 102. The driver 115 may in particular convert electrical signals picked off from the electrical connection 103 into electrical signals suitable for feeding the light-emitting diodes 102. For this purpose, the driver 115 may have, for example, a transformer and electronic components ("driver electronics"), which generate waste heat during operation. The driver housing 114, and consequently the driver cavity 113, are substantially air- and moisture-impermeable apart from the cable duct 112.

Figure 2:
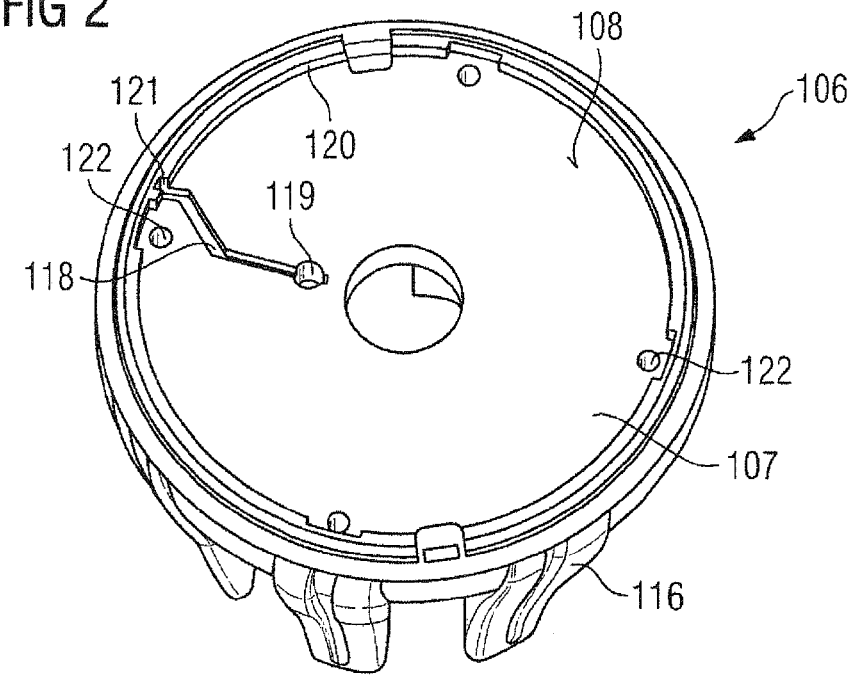
FIG. 2 shows in a view obliquely from above a heat sink of the lighting device of the first embodiment.

FIG. 2 shows in a view obliquely from above the heat sink 106 of the lighting device of the first embodiment.

Formed in the front side 108 of the front region 107 of the heat sink 106 is a groove 118 in the form of a longitudinal groove.

The (longitudinal) groove 118 runs from a through-opening 119, running perpendicularly through the front region 107, to a periphery 120 of the heat sink 106, rising up perpendicularly toward the front. The periphery 120 serves for the fastening of the covering 104 and for positioning and bounding the heat conducting sheet 110 shown in FIG. 3. At the periphery 120, the groove 118 adjoins a clearance 121 of the periphery 120 that is adjacent the bulb space 111. The groove 118 does not run in a straight line, but goes around a screw bore 122 for the fastening of the heat conducting sheet 110.

Figure 3:
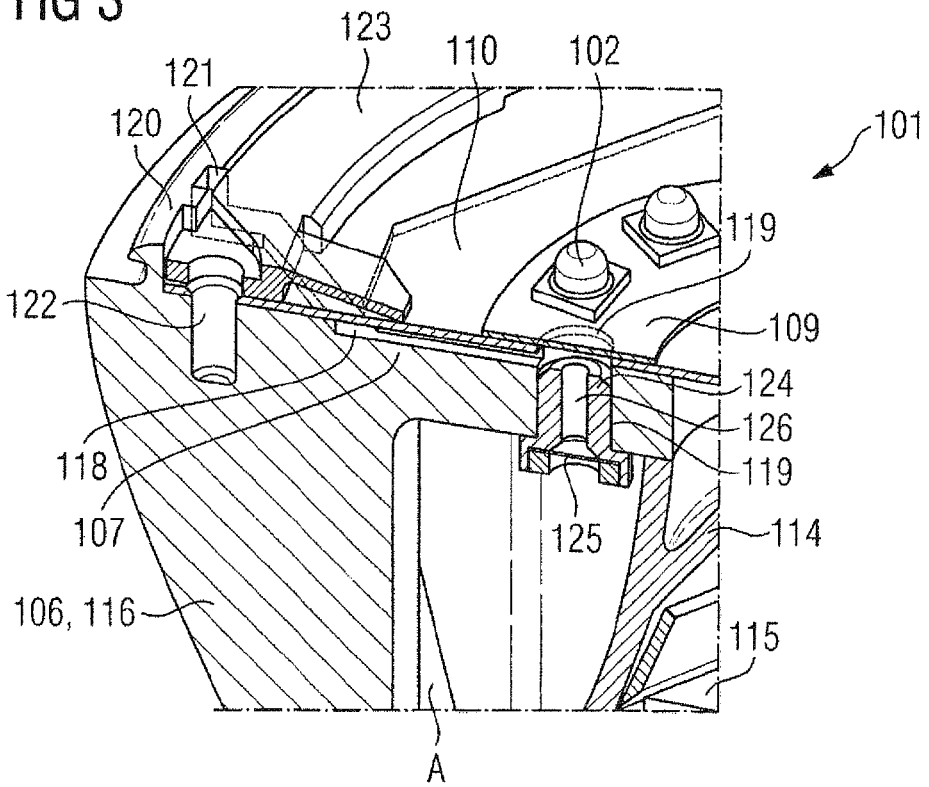
FIG. 3 shows as a sectional representation in an oblique view a more detailed cutout from the lighting device according to the first embodiment in a region of a bulb space.
Figure 4:
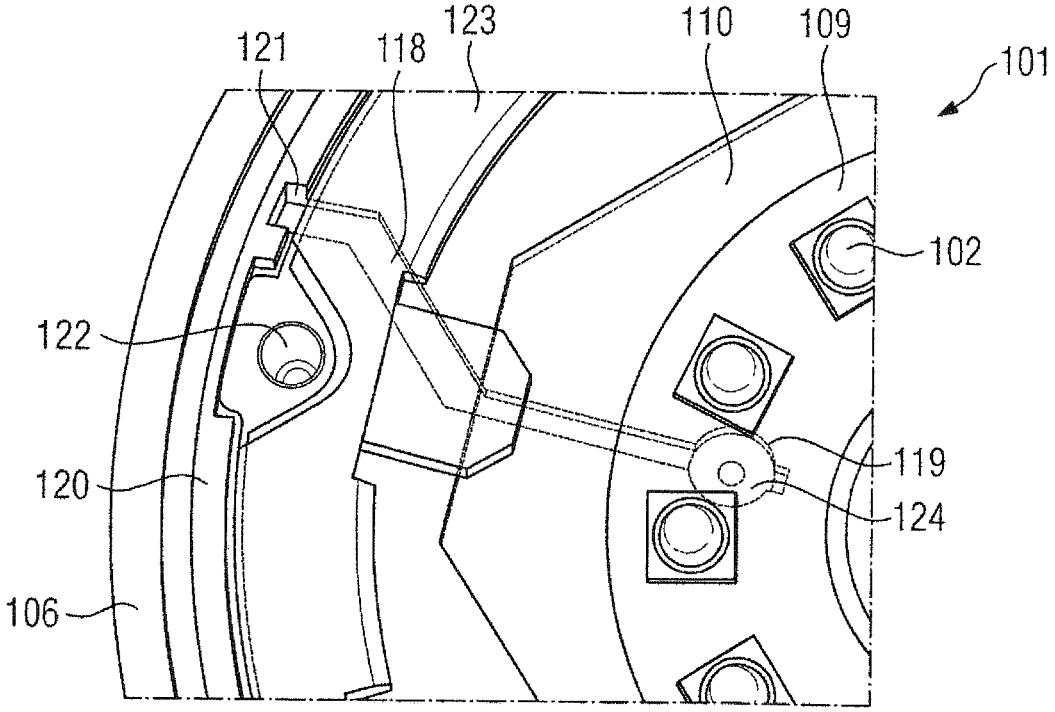
FIG. 4 shows in a view obliquely from above a cutout of the lighting device of the first embodiment in a region of the bulb space.

FIG. 3 shows as a sectional representation in an oblique view a more detailed cutout from the lighting device 101. FIG. 4 shows in a view obliquely from above a cutout from the heat sink 106 in the front region 107.

The front side 108 of the front region 107 is covered by the sufficiently stiff heat conducting sheet 110 as far as the periphery 120. The heat conducting sheet 110 is held on the front side 108 by means of a pressing ring 123, the pressing ring being fixed by means of screwing at the screw bores 122. The heat conducting sheet 110 consequently covers the groove 118, so that the groove 118 and the heat conducting sheet 110 form a channel. Since the groove 118 adjoins the clearance 121 of the periphery 120, it is fluidically connected to the bulb space 111. On the other hand, it goes over into the through-opening 119. Inserted into the through-opening 119 from below, and closing it, is a transmission element in the form of a hollow plug 124, the plug 124 having a semipermeable membrane 125, which covers a transmission bore 126 of the plug 124. The membrane 125 is molded in place in the plug 124. Altogether, the plug 124, the covered groove 118 and the clearance 121 produce a common fluid channel, which connects the bulb space 111 to an area outside A, the membrane 125 crossing over the fluid channel over the full surface area thereof. The membrane 125 is semipermeable and transmissive to air in both directions, but is only transmissive to water in the direction from the bulb space 111 to the area outside A.

During operation of the lighting device 101, the light-emitting diodes 102 and the driver 115 heat up, so that the air in the bulb space 111 and in the driver cavity 113 expands. A harmful positive pressure therein can be reduced by an air stream through the membrane 125 into the area outside A. Moisture that is present in the bulb space 111 and in the driver cavity 113 can also be removed thereby. After completion of the operation of the lighting device 101, the light-emitting diodes 102 and the driver 115 cool down, so that the air in the bulb space 111 and in the driver cavity 113 contracts. A harmful negative pressure therein may be reduced by an air stream through the membrane 125 from the area outside A into the bulb space 111 and into the driver cavity 113. By contrast, moisture that is present in the area outside A is hindered from being sucked into the bulb space 111 by the membrane 125.

The covered groove 118 and the plug 124 (or the fluid channel thereof) also form a sufficiently long creepage and air path, in particular on account of the great length of the covered groove 118.

Figure 5:
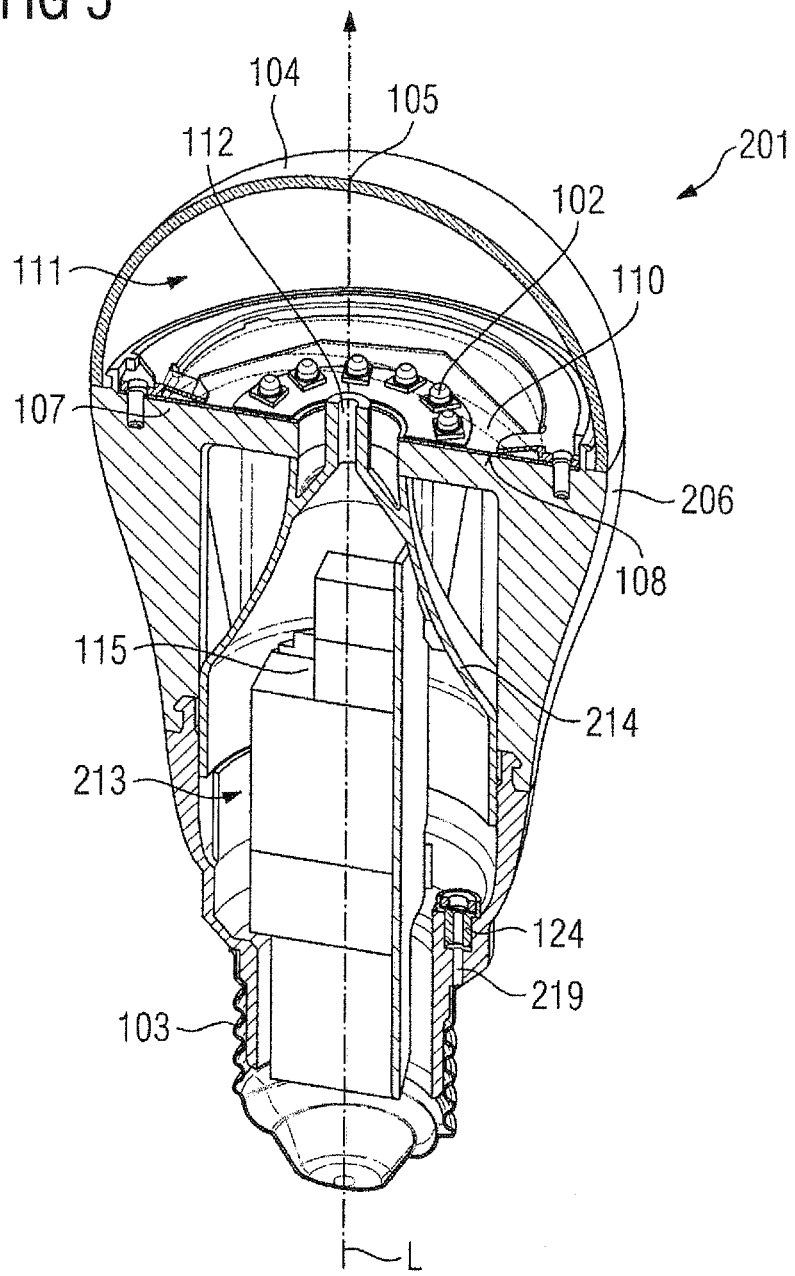
FIG. 5 shows as a sectional representation in an oblique view a lighting device according to a second embodiment, configured as an incandescent retrofit lamp.
Figure 6:
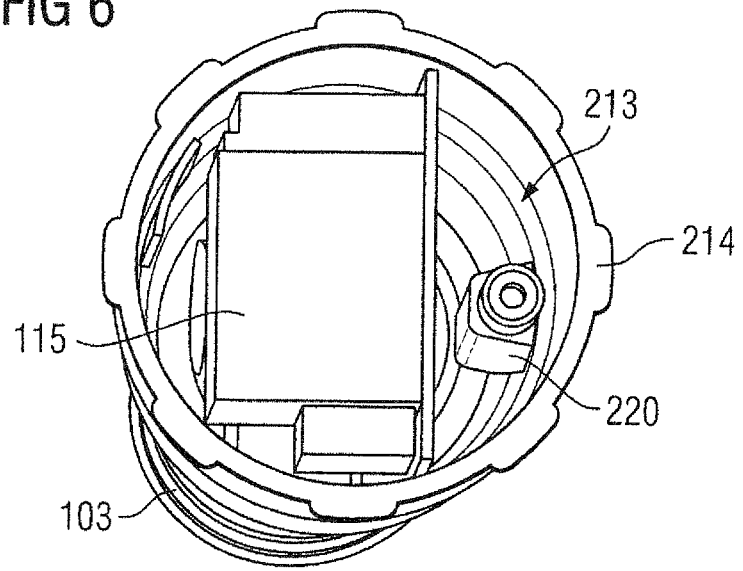
FIG. 6 shows as a sectional representation in a view obliquely from above a driver housing of the lighting device according to the second embodiment.
Figure 7:
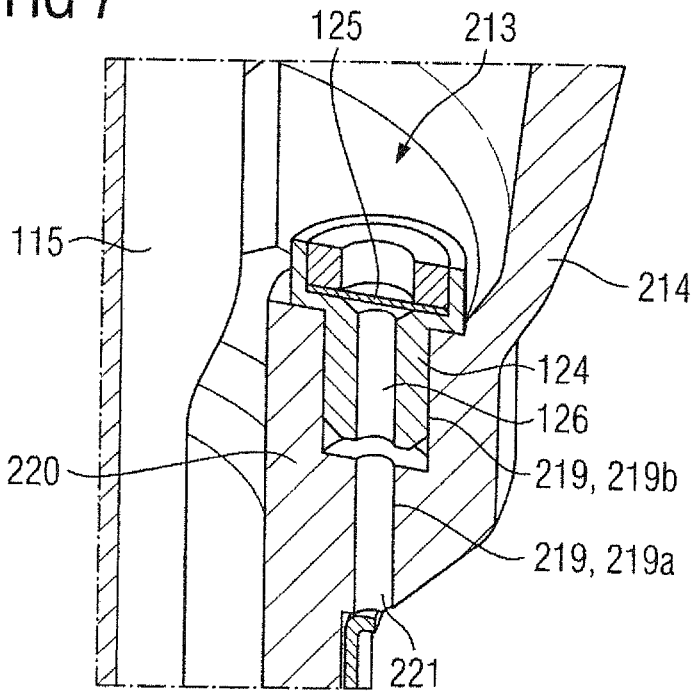
FIG. 7 shows as a sectional representation in a side view a cutout from the driver housing of the lighting device according to the second embodiment.

FIG. 5 shows as a sectional representation in an oblique view a lighting device 201 according to a second embodiment, configured as an incandescent retrofit lamp. FIG. 6 shows as a sectional representation in a view obliquely from above a driver housing 214 of the lighting device 201. FIG. 7 shows as a sectional representation in a side view a cutout from the driver housing 214 in a region of a tubular through-opening 219 or bore.

Figure 8:
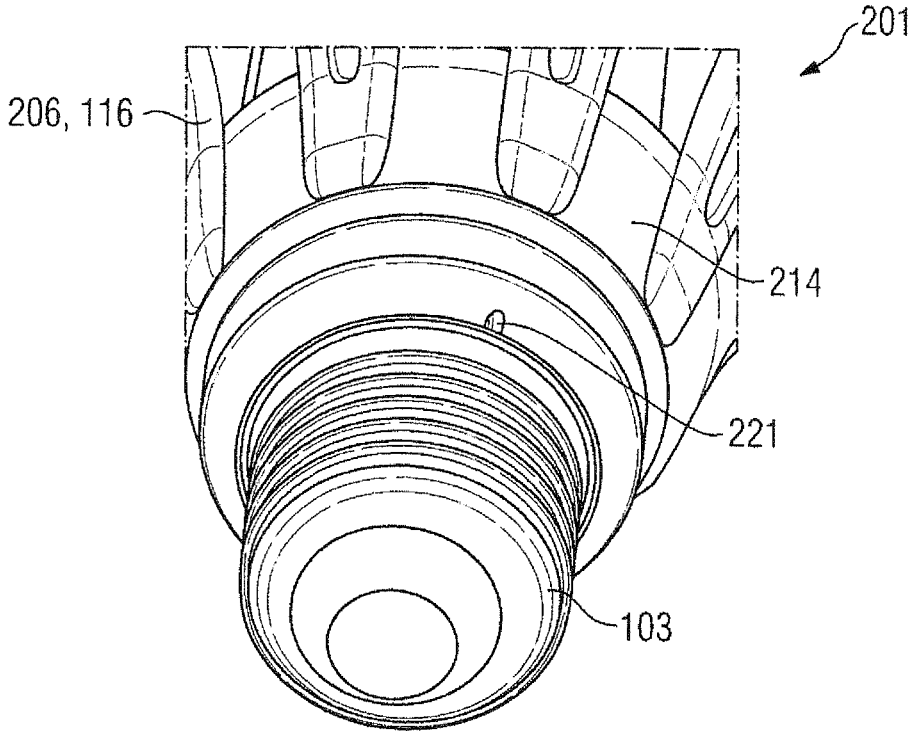
FIG. 8 shows in a view obliquely from below in the form of a cutout the driver housing of the lighting device according to the second embodiment.

The lighting device 201 is constructed in principle similarly to the lighting device 101, but with the through-opening 219 now opening out such that it is connected into the driver cavity 213. In order to ensure a sufficient length of the through-opening 219, the driver housing 214 or a wall thereof is reinforced in the region of the through-opening 219. This wall reinforcement 220 extends into the driver cavity 213, so that an outer contour of the driver housing 214 is not adversely affected. As shown in FIG. 8, the through-opening 219 can only be seen from the outside by a small entry hole 221. From the entry hole 221, the through-opening 219 extends perpendicularly (parallel to the longitudinal axis).

As represented in particular in FIG. 7, beginning at the entry hole 221, the through-opening 219 is configured initially as a relatively thin portion 219*a*, which in the direction of the driver cavity 213 goes over into a wide portion 219*b*. From the side of the driver cavity 213, the plug 124 is inserted in the wide portion 219*b* of the through-opening 219, and closes it, the plug 124 having the semipermeable membrane 125, which covers the transmission bore 126 of the plug 124.

During operation of the lighting device 201, the light-emitting diodes 102 and the driver 115 heat up, so that the air in the bulb space 111 and in the driver cavity 213 expands. A harmful positive pressure therein can be reduced by an air stream through the membrane 125 into the area outside A. Moisture that is present in the bulb space 111 and in the driver cavity 113 can also be removed thereby. After completion of the operation of the lighting device 201, the light-emitting diodes 102 and the driver 115 cool down, so that the air in the bulb space 111 and in the driver cavity 213 contracts. A harmful negative pressure therein can be reduced by an air stream through the membrane 125 from the area outside A into the bulb space 111 and into the driver cavity 213. By contrast, moisture that is present in the area outside is hindered from being sucked into the driver cavity 213 (and consequently also into the bulb space 111) by the membrane 125.

An air and creepage path is determined substantially by the length of the through-opening 219 and can be easily set by different dimensioning of the wall reinforcement 220.

Figure 9:
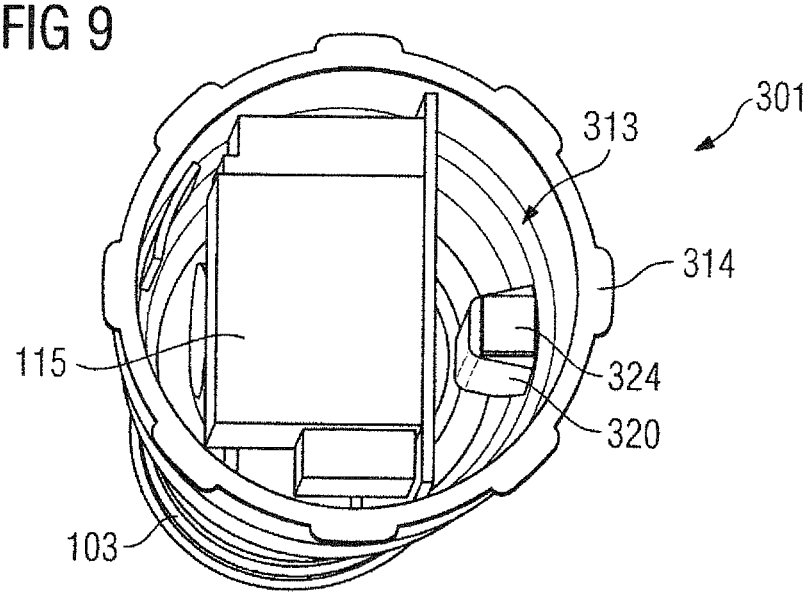
FIG. 9 shows as a sectional representation in a view obliquely from above a driver housing of a lighting device according to a third embodiment.
Figure 10:
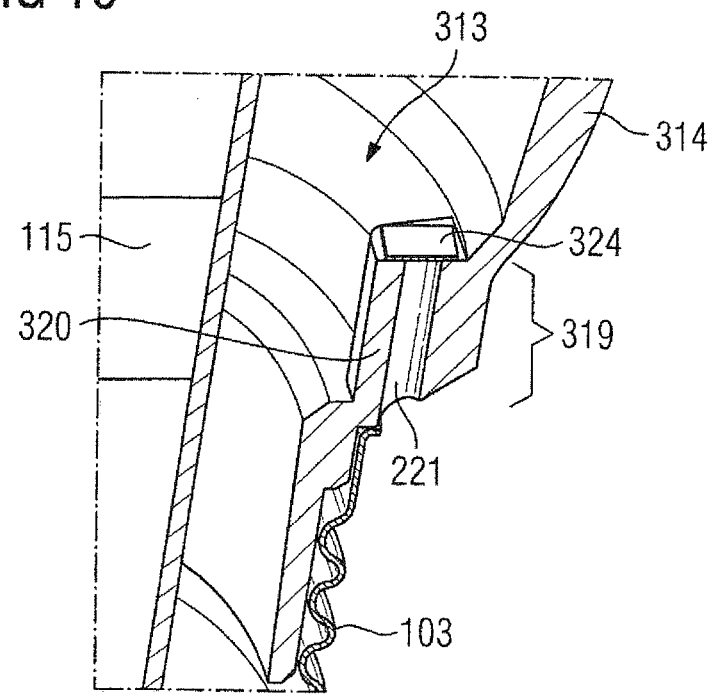
FIG. 10 shows as a sectional representation in a side view a cutout from the driver housing of the lighting device according to the third embodiment.

FIG. 9 shows as a sectional representation in a view obliquely from above a driver housing 314 of a lighting device 301 according to a third embodiment. FIG. 10 shows as a sectional representation in a side view a cutout from the driver housing 314.

The lighting device 301 is constructed in principle similarly to the lighting device 201, the through-opening 319 likewise being made to extend through a wall reinforcement 320 and opening out into the driver cavity 313, but now being covered over adhesively on the side of the driver cavity 313 by a transmission element in the form of a membrane sheet 324. The through-opening 319 has a constant diameter, which can be kept small and which can likewise only be seen from the outside by an entry hole 221.

The membrane sheet 324 may in particular be a self-adhesive membrane sheet.

Figure 11:
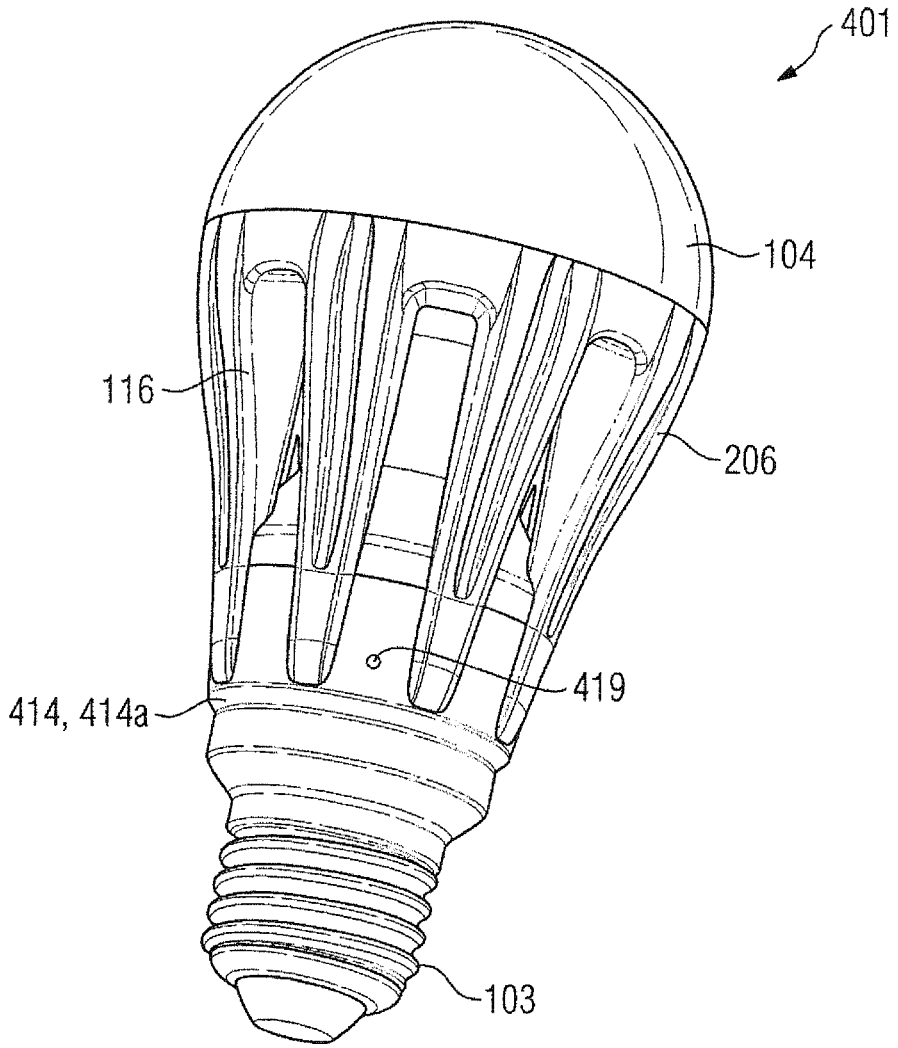
FIG. 11 shows in an oblique view a lighting device according to a fourth embodiment, configured as an incandescent retrofit lamp.

FIG. 11 shows in an oblique view a lighting device 401 according to a fourth embodiment, configured as an incandescent retrofit lamp. The driver housing 414 has a through-opening 419 leading transversely through a wall 414*a* of the driver housing 414.

Figure 12:
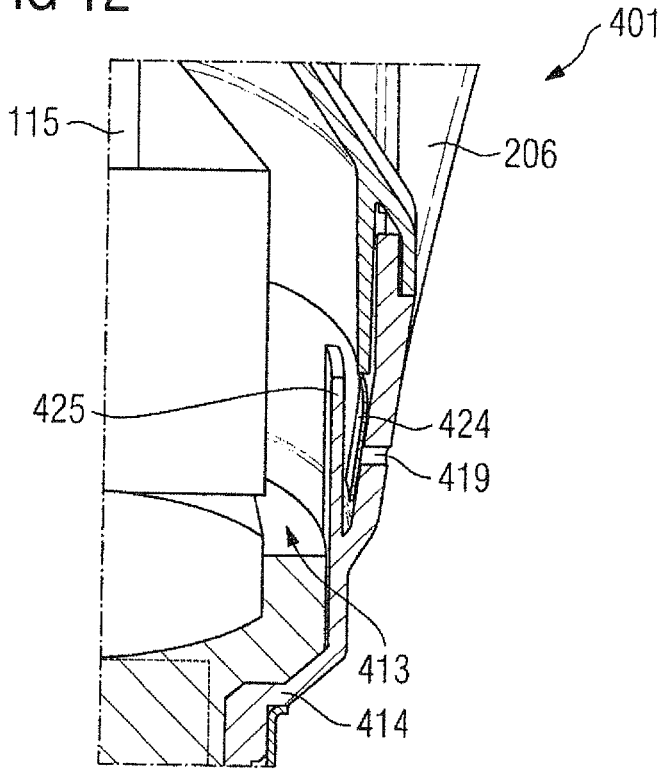
FIG. 12 shows as a sectional representation in a side view a cutout from the driver housing of the lighting device according to the fourth embodiment.
Figure 13:
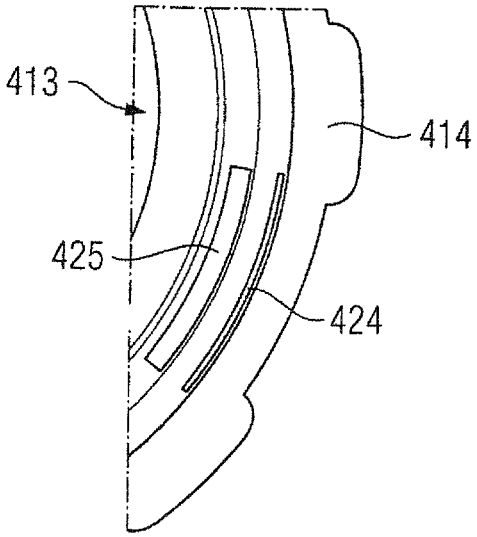
FIG. 13 shows as a sectional representation in a view from above a cutout from the driver housing of the lighting device according to the fourth embodiment.

FIG. 12 shows a cutout from the driver housing 414 of the Lighting device 101. FIG. 13 shows as a sectional representation in a view from above a further cutout from the driver housing 414. A mouth of the through-opening 419 into the driver cavity 413 is covered by a self-adhesive membrane sheet 424. At a distance from the mouth, and consequently also from the membrane sheet 424, there is a separating wall 425, which represents part of the driver housing 414 and covers over the membrane sheet 424 at a distance from it (and consequently not in a sealed manner). The separating wall 425 brings about a longer air and creepage path for electrically conducting parts of the driver 115 with respect to the outside A.

It goes without saying that the disclosure is not restricted to the exemplary embodiments that are shown.

Thus, features of the various embodiments may also be exchanged or combined. For example, the disclosure includes a lighting device that has a transmission element in the region of the bulb space and a transmission element in the region of the driver cavity. The transmission element in the region of the bulb space may also be covered by a membrane sheet.

Although the embodiments concern incandescent retrofit lamps, the disclosure is not restricted to these. Thus, the disclosure may, for example, also be applied to halogen retrofit lamps. In this case, the space for receiving at least one functional element may be, for example, a space bounded laterally by a reflector (in particular in the form of a half shell), that receives semiconductor light sources. For example, through the reflector there may run a through-opening which, by means of the transmission element, is transmissive to air in both directions and is closed such that it is non-transmissive to water, at least in the direction of the space.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF DESIGNATIONS

101 Lighting device
102 Light-emitting diodes
103 Electrical connection
104 Covering
105 Tip
106 Heat sink
107 Front region
108 Front side
109 Substrate
110 Heat conducting sheet
111 Bulb space
112 Cable duct
113 Driver cavity
114 Driver housing
115 Driver
116 Cooling strut
118 Groove
119 Through-opening
120 Periphery
121 Clearance
122 Screw bore
123 Pressing ring
124 Plug
125 Membrane
126 Transmission bore
213 Driver cavity
214 Driver housing
219 Through-opening
219*a* Thin portion
219*b* Wide portion
220 Wall reinforcement
221 Entry hole
301 Lighting device
313 Driver cavity
314 Driver housing
319 Through-opening
320 Wall reinforcement
324 Membrane sheet
401 Lighting device
413 Driver cavity
414 Driver housing
414*a* Wall of the driver housing
419 Through-opening
424 Membrane sheet
425 Separating wall
A Area outside
L Longitudinal axis

The invention claimed is:

1. A lighting device, comprising:

at least one space for receiving at least one functional element, wherein the space is connected to the environment through at least one semipermeable transmission element and, except for the semipereable transmission element, closed off in a sealed manner, and wherein the at least one transmission element is transmissive to air and non-transmissive to water, at least from the environment to the space.

2. The lighting device as claimed in claim 1, wherein the at least one transmission element only is non-transmissive to water from the environment to the space.

3. The lighting device as claimed in claim 1, wherein the at least one transmission element is non-transmissive to water.

4. The lighting device as claimed in claim 1, wherein the space is a bulb space, which is partially bounded by a light-transmissive covering, and the at least one functional element has at least one light source.

5. The lighting device as claimed in claim 4, wherein the space is partially bounded by a heat sink, which is connected in a sealed manner to the covering and on which the at least one light source is arranged.

6. The lighting device as claimed in claim 5, wherein the at least one light source is mounted on a substrate, the substrate being fastened on a front side of the heat sink, a through-opening, which is closed by means of the transmission element, runs through the heat sink, a longitudinal groove, which adjoins the through-opening, runs in the front side, the through-opening and at least part of the longitudinal groove that extends from the through-opening are covered, so that they form a common fluid channel, and the end of the longitudinal groove opposite from the through-opening is fluidically connected to the bulb space.

7. The lighting device as claimed in claim 6, wherein the longitudinal groove is made to extend up to an upright periphery of the front side and the longitudinal groove adjoins a clearance of the periphery that is adjacent the bulb space.

8. The lighting device as claimed in claim 1, wherein the space is a driver cavity and the functional element is a driver for feeding at least one light source.

9. The lighting device as claimed in claim 8, wherein the bulb space and the driver cavity are fluidically connected to one another.

10. The lighting device as claimed in claim 8, wherein the driver cavity is bounded by a driver housing and the driver housing has a through -opening which opens out into the driver cavity and leads through a reinforced region of the driver housing.

11. The lighting device as claimed in claim 8, wherein the driver cavity is bounded by a driver housing and the driver housing has a through -opening leading through the driver housing, there being in the driver cavity a separating wall of a laterally limited extent, which covers over the through-opening at a distance from it.

12. The lighting device as claimed in claim 6, wherein a plug is inserted in the through-opening.

13. The lighting device as claimed in claim 6, wherein the through-opening is covered over adhesively by the transmission element.

14. The lighting device as claimed in claim 13, wherein the transmission element is self-adhesive.

15. The lighting device as claimed in claim 1, wherein the lighting device is a semiconductor retrofit lamp and has at least one semiconductor light source.

16. The lighting device as claimed in claim 4, wherein the at least one light source includes a semiconductor source.

17. The lighting device as claimed in claim 9, wherein a plug is inserted in the through-opening.

18. The lighting device as claimed in claim 10, wherein the through-opening is covered over adhesively by the transmission element.

* * * * *